US008915782B2

(12) United States Patent
Fujimoto

(10) Patent No.: US 8,915,782 B2
(45) Date of Patent: Dec. 23, 2014

(54) GAME MANAGEMENT SYSTEM

(75) Inventor: Jun Fujimoto, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1336 days.

(21) Appl. No.: 12/045,052

(22) Filed: Mar. 10, 2008

(65) Prior Publication Data

US 2008/0161104 A1 Jul. 3, 2008

Related U.S. Application Data

(63) Continuation of application No. 10/735,805, filed on Dec. 16, 2003, now abandoned.

(30) Foreign Application Priority Data

Dec. 16, 2002 (JP) ..... 2002-383347

(51) Int. Cl.
*G07F 17/32* (2006.01)

(52) U.S. Cl.
CPC ..... *G07F 17/32* (2013.01); *G07F 17/3239* (2013.01); *G07F 17/3241* (2013.01); *G07F 17/322* (2013.01); *G07F 17/3232* (2013.01)
USPC ..... 463/29; 463/25; 463/42; 463/43

(58) Field of Classification Search
USPC ..... 463/25, 29, 42, 43
See application file for complete search history.

(56) References Cited

U.S. PATENT DOCUMENTS

| | | | | |
|---|---|---|---|---|
| 4,578,654 | A * | 3/1986 | Tait | 333/175 |
| 5,204,681 | A | 4/1993 | Greene | |
| 5,381,137 | A * | 1/1995 | Ghaem et al. | 340/572.5 |
| 5,429,361 | A | 7/1995 | Raven et al. | |
| 5,446,447 | A | 8/1995 | Carney et al. | |
| 5,510,769 | A * | 4/1996 | Kajfez et al. | 340/572.5 |
| 5,605,334 | A * | 2/1997 | McCrea, Jr. | 273/309 |
| 5,779,546 | A | 7/1998 | Meissner et al. | |
| 5,809,482 | A | 9/1998 | Strisower | |
| 5,941,769 | A | 8/1999 | Order | |
| 6,094,133 | A * | 7/2000 | Shimamura et al. | 340/505 |
| 6,280,328 | B1 * | 8/2001 | Holch et al. | 463/42 |

(Continued)

FOREIGN PATENT DOCUMENTS

| | | |
|---|---|---|
| JP | 2000-357272 | 12/2000 |
| JP | 2001-229350 | 8/2001 |

(Continued)

*Primary Examiner* — Jasson Yoo
(74) *Attorney, Agent, or Firm* — KMF Patent Services, PLLC; S. Peter Konzel; Kenneth M. Fagin

(57) ABSTRACT

A game management system includes: a resonant tag which records card identification information and is provided with each of a plurality of cards; a wireless ID tag which records chip identification information and is provided with each of a plurality of chips; a first identification information detector which is provided with a game table and detects the card identification information concerning each of the plurality of cards; a second identification information detector which is provided with the game table and detects the chip identification information concerning each of the plurality of chips; a readout unit which is provided with the game table and acquires personal information for identifying a participant in a game; and a PTS server and a accumulation/analysis server which manage tracks and results of the game played on the game table in association with the personal information based on the card and chip identification information.

8 Claims, 6 Drawing Sheets

PRESENT GAME

| MEMBER | BEGINNING OF GAME: KIND OF DEALT CARD | BEGINNING OF GAME: NUMBER OF DEALT CARDS | DURING GAME: MOVEMENT HISTORY OF CARD | END OF GAME: KIND OF REMAINING CARD | END OF GAME: NUMBER OF REMAINING CARDS |
|---|---|---|---|---|---|
| PARTICIPANT P1 | ♥A, ♦2, ♣5 | 3 | ♥A→♠2 ♦2→♣8 ⋮ | ♠2, ♣8, ♣5 | 3 |
| PARTICIPANT P2 | ♥7, ♦A, ♠Q | 3 | ♥7→♠2 ♦A→♣9 ⋮ | ♠2, ♣9, ♠Q | 3 |
| PARTICIPANT P3 | ♥5, ♣7, ♠8 | 3 | ♥5→♠3 ♣7→♣K ⋮ | ♠3, ♣K, ♠8 | 3 |
| DEALER D | ♥3, ♣J, ♠2 | 3 | ♥3→♠3 ♣J→♣3 ⋮ | ♠3, ♣3, ♠2 | 3 |

(56) References Cited

U.S. PATENT DOCUMENTS

| | | | | |
|---|---|---|---|---|
| 6,460,848 | B1 | 10/2002 | Soltys et al. | |
| 2002/0123376 | A1* | 9/2002 | Walker et al. | 463/11 |
| 2002/0147042 | A1* | 10/2002 | Vuong et al. | 463/40 |
| 2003/0003997 | A1* | 1/2003 | Vuong et al. | 463/42 |
| 2003/0228898 | A1* | 12/2003 | Rowe | 463/25 |

FOREIGN PATENT DOCUMENTS

| | | | | |
|---|---|---|---|---|
| JP | 2002-123619 | 4/2002 | | |
| JP | 2002-140631 | 5/2002 | | |
| JP | 2003-47775 | 2/2003 | | |
| JP | 2003-47779 | 2/2003 | | |
| JP | 2003-53041 | 2/2003 | | |
| JP | 2003-53042 | 2/2003 | | |
| JP | 2003-144760 | 5/2003 | | |
| JP | 2003-150838 | 5/2003 | | |
| JP | 2003-150852 | 5/2003 | | |
| JP | 2003-305271 | 10/2003 | | |
| WO | WO 97/38366 | * 10/1997 | | G06F 7/04 |

* cited by examiner

Fig.3A

| PRESENT GAME | | BEGINNING OF GAME | | DURING GAME | END OF GAME | |
|---|---|---|---|---|---|---|
| | MEMBER | KIND OF DEALT CARD | NUMBER OF DEALT CARDS | MOVEMENT HISTORY OF CARD | KIND OF REMAINING CARD | NUMBER OF REMAINING CARDS |
| | PARTICIPANT P1 | ♥A, ♦2, ♣5 | 3 | ♥A→♠2<br>♦2→♣8<br>⋮ | ♠2, ♣8, ♣5 | 3 |
| | PARTICIPANT P2 | ♥7, ♦A, ♠Q | 3 | ♥7→♠2<br>♦A→♣9<br>⋮ | ♠2, ♣9, ♠Q | 3 |
| | PARTICIPANT P3 | ♥5, ♣7, ♠8 | 3 | ♥5→♠3<br>♣7→♣K<br>⋮ | ♠3, ♣K, ♠8 | 3 |
| | DEALER D | ♥3, ♣J, ♠2 | 3 | ♥3→♠3<br>♣J→♣3<br>⋮ | ♠3, ♣3, ♠2 | 3 |

Fig.3B

| PRESENT GAME | | BEGINNING OF GAME | | DURING GAME | END OF GAME | |
|---|---|---|---|---|---|---|
| | MEMBER | KIND OF BET CHIP | NUMBER OF BET CHIPS | MOVEMENT HISTORY OF CHIP | KIND OF REMAINING CHIP | NUMBER OF REMAINING CHIPS |
| | PARTICIPANT P1 | 1$, 10$ | 2 | TO PARTICIPANT P2<br>⋮ | 0$ | 0 |
| | PARTICIPANT P2 | 1$ | 1 | 1$ ×3, 10$<br>⋮ | 1$ ×3, 5$, 10$ ×3 | 7 |
| | PARTICIPANT P3 | 1$, 10$ | 2 | TO PARTICIPANT P2<br>⋮ | 0$ | 0 |
| | DEALER D | 5$, 10$ | 2 | TO PARTICIPANT P2<br>⋮ | 0$ | 0 |

*Fig.4*

| HISTORY NO. | USER ID | GAME TABLE ID | GAME START TIME | GAME END TIME | INVESTMENT | RETURN | FRAUD DETECTION FLAG |
|---|---|---|---|---|---|---|---|
| 1 | TARO ARUZE | 24-TABLE 1-SEAT B | HISTORY NO. | 20:00 | $800 | $1, 500 | 1 |
| 2 | JIRO ARUZE | 24-TABLE 1-SEAT A | HISTORY NO. | 20:00 | $200 | $2, 000 | 0 |
| 3 | ▪ | ▪ | ▪ | ▪ | ▪ | ▪ | ▪ |
| ▪ | ▪ | ▪ | ▪ | ▪ | ▪ | ▪ | ▪ |
| ▪ | ▪ | ▪ | ▪ | ▪ | ▪ | ▪ | ▪ |
| ▪ | ▪ | ▪ | ▪ | ▪ | ▪ | ▪ | ▪ |
| ▪ | ▪ | ▪ | ▪ | ▪ | ▪ | ▪ | ▪ |

Fig.5A

| GAME NO. | GAME TABLE ID | TIME | BEGINNING OF GAME | | | | | |
|---|---|---|---|---|---|---|---|---|
| | | | NUMBER OF CARDS | CARD 1 | CARD 2 | CARD 3 | CARD 4 | CARD 5 |
| 1 | 24-TABLE 1-SEAT B | 19:02 | 5 | ♥K | ♥K | ♥K | ♣3 | ♣2 |
| 1 | 24-TABLE 1-SEAT A | 19:02 | 5 | ♠A | ♠A | ♠A | ♣K | ♣5 |
| ⋮ | ⋮ | ⋮ | ⋮ | ⋮ | ⋮ | ⋮ | ⋮ | ⋮ |

Fig.5B

| GAME NO. | GAME TABLE ID | TIME | MOVEMENT HISTORY OF CARD |
|---|---|---|---|
| 1 | 24-TABLE 1-SEAT B | 19:03 | ♣2→♣3 |
| 1 | 24-TABLE 1-SEAT A | 19:03 | ♣5→ |
| ⋮ | ⋮ | ⋮ | ⋮ |

Fig.5C

| GAME NO. | GAME TABLE ID | TIME | END OF GAME | | | | | |
|---|---|---|---|---|---|---|---|---|
| | | | NUMBER OF CARDS | CARD 1 | CARD 2 | CARD 3 | CARD 4 | CARD 5 |
| 1 | 24-TABLE 1-SEAT B | 19:05 | 5 | ♥K | ♥K | ♥K | ♣3 | ♣3 |
| 1 | 24-TABLE 1-SEAT A | 19:05 | 4 | ♠A | ♠A | ♠A | ♣K | |
| ⋮ | ⋮ | ⋮ | ⋮ | ⋮ | ⋮ | ⋮ | ⋮ | ⋮ |

*Fig.6*

| No. | GAME TABLE ID | BET TIME | NUMBER OF BETS | | | RETURN TIME | NUMBER OF RETURNS | | |
|---|---|---|---|---|---|---|---|---|---|
| | | | 1 $ | 5 $ | 10 $ | | 1 $ | 5 $ | 10 $ |
| 1 | 24-TABLE 1-SEAT B | 19:02 | 5 | 5 | 5 | 19:05 | 40 | 40 | 40 |
| 1 | 24-TABLE 1-SEAT A | 19:02 | 3 | 3 | 3 | 19:05 | 15 | 15 | 15 |
| ⋮ | ⋮ | ⋮ | ⋮ | ⋮ | ⋮ | ⋮ | ⋮ | ⋮ | ⋮ |

GAME MANAGEMENT SYSTEM

CROSS REFERENCE TO RELATED APPLICATIONS

This application is based upon and claims the benefit of priority from the prior Japanese Patent Applications No. 2002-383347, filed on Dec. 16, 2002; the entire contents of which are incorporated herein by reference.

BACKGROUND OF THE INVENTION

1. Field of the Invention

The present invention relates to a game management system for managing a game, which is played on a game table and employs a plurality of cards and chips.

2. Related Background Art

In games employing a plurality of cards and chips, for example, the cards are exchanged between a dealer and players facing each other over a game table, and the chips according to bets are exchanged between the players through the dealer. A casino hotel is known as an establishment for playing such card games. In a casino hotel, a guest who has received a house card (e.g., an ID card on which an identification number is recorded to prove him/herself) upon check-in, in other words, a user of the casino hotel can utilize the house card to use different facilities in the hotel. The house card is read out at the cashiers in restaurants and bars in the hotel so that the bills are stored in a hotel server. Upon check-out, all the bills are displayed on the terminal at the front desk. In addition, the house card can be utilized in transportation outside the hotel during a stay by connecting the transportation to the hotel via network.

SUMMARY OF THE INVENTION

Incidentally, a game charge at a casino is billed separately in conventional casino hotels. Accordingly, the aforementioned house card cannot be utilized to play games. In this case, there is a problem that the hotels cannot provide obliging service to their guests. It is because types of games played at a casino and money spent for the games cannot be recorded onto a history from upon check-in until check-out.

The present invention has been devised to solve the problem. An object of the present invention is to provide a game management system capable of collectively managing the tracks and the results of the games played by the user.

In order to achieve the object, the game management system of the present invention for managing a game, which is played on a game table and employs a plurality of cards and a plurality of chips, includes: (a) card identification information recording means for recording card identification information for identifying each of the plurality of cards, the card identification information recording means being provided with each of the plurality of cards; (b) chip identification information recording means for recording chip identification information for identifying each of the plurality of chips, the chip identification information recording means being provided with each of the plurality of chips; (c) first identification information detecting means for detecting the card identification information recorded on the card identification information recording means provided with each of the plurality of cards, the first identification information detecting means being provided with the game table; (d) second identification information detecting means for detecting the chip identification information recorded on the chip identification information recording means provided with each of the plurality of chips, the second identification information detecting means being provided with the game table; (e) individual identifying means for acquiring personal information for identifying a participant in the game, the individual identifying means being provided with the game table; and (f) managing means for managing tracks and results of the game played on the game table in association with the personal information, which is acquired by the individual identifying means, based on the card identification information detected by the first identification information detecting means and the chip identification information detected by the second identification information detecting means.

According to the present invention, the individual identifying means provided with the game table recognizes the personal information concerning the participant in the game. In other words, the individual identifying means recognizes the user of the facility. The first and second identification information detecting means provided with the game table recognize the cards and the chips used by the participant during the game respectively. Therefore, the managing means can collectively manage the tracks and the results of the game played on the game table in association with the personal information.

In the game management system of the present invention, information concerning the cards at the beginning of the game and a movement history of the cards during the game can be included as the track of the game. It is possible to include information on the cards remaining at the end of the game as the result of the game. Kinds and the number of cards dealt at the beginning of the game can be included as the information concerning the cards at the beginning of the game. It is possible to include kinds and the number of the remaining cards at the end of the game as the information on the cards remaining at the end of the game.

In the game management system of the present invention, information concerning the chips bet at the beginning of the game and a movement history of each of the chips during the game can be included as the track of the game. It is possible to include information concerning the remaining chips at the end of the game as the result of the game. Kinds and the number of chips bet at the beginning of the game can be included as the information concerning the chips bet at the beginning of the game. Kinds and the number of the remaining chips at the end of the game can be included as the information concerning the chips remaining at the end of the game.

Moreover, in the game management system of the present invention, a total amount of the remaining money at the end of the game can be included as the result of the game.

In the game management system of the present invention, it is preferred that the managing means detect fraud in the game committed by the participant identified by the personal information based on the tracks and the results associated with the personal information. As previously mentioned, the tracks and the results of the cards and the chips used by the participant in the game can be managed in association with the personal information for identifying the participant. Thus, it is possible for the managing means to identify the participant in the game and detect the fraud committed during the game.

In the game management system of the present invention, the individual identifying means can includes: an ID card on which the personal information for identifying the participant in the game is recorded, the ID card being distributed to an individual identified by the personal information; and readout means for acquiring the personal information by reading out from the ID card, the readout means being provided on the game table.

The ID card can be linked to various management systems, in addition to the game management system. It is possible for the ID card to have at least a function as a credit card to pay for goods as well as drinks and meals.

In the game management system of the present invention, the ID card may be provided with a deposit checking unit for checking the amount of personal deposit. The game table may be provided with bet inputting means for the individual to input a bet on the game based on the amount of deposit checked by the deposit checking unit. According to the present invention, the participant in the game can play the games without using chips or cash.

BRIEF DESCRIPTION OF THE DRAWINGS

FIG. 3A is a view showing an example of a table managed by a PTS server regarding all the histories of the cards.

FIG. 3B is a view showing an example of a table managed by the PTS server regarding all the histories of the chips.

FIG. 4 is a view showing an example of a table managed by the PTS server regarding the results of games.

FIG. 5A is a view showing an example of a table managed by the PTS server regarding the cards at the beginning of a game.

FIG. 5B is a view showing an example of a table managed by the PTS server regarding a movement history of the cards during a game.

FIG. 5C is a view showing an example of a table managed by the PTS server regarding the cards at the end of a game.

FIG. 6 is a view showing an example of a table managed by the PTS server regarding the chips.

DESCRIPTION OF THE PREFERRED EMBODIMENTS

Figure 1:
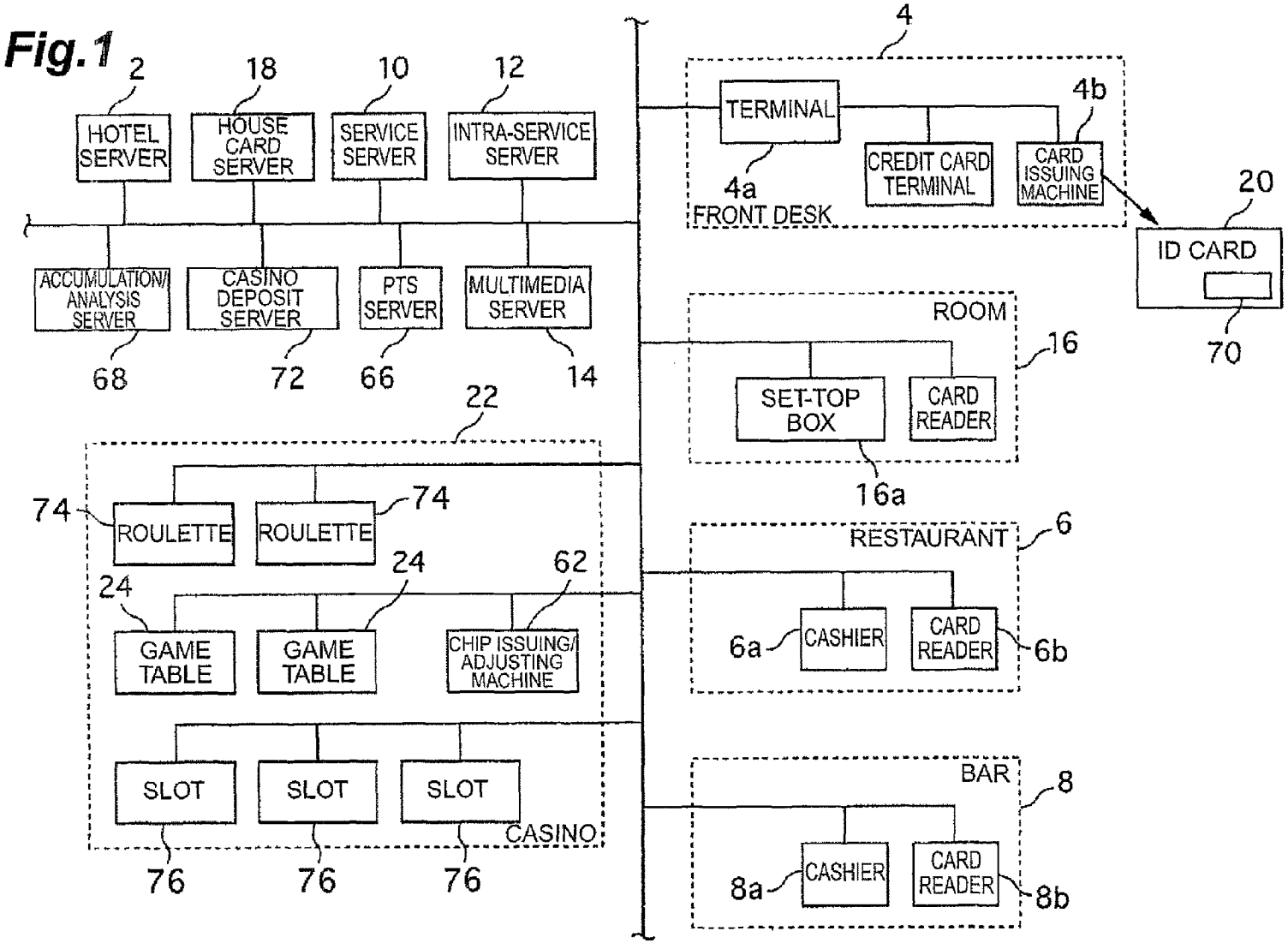
FIG. 1 shows a configuration of a casino/hotel system according to an embodiment of the present invention.

Hereinafter, a game management system according to an embodiment of the present invention is described with reference to the accompanying drawings. FIG. 1 shows a configuration of a casino/hotel system according to an embodiment of the present invention.

A plurality of servers, terminals, and the like are connected via network to construct the casino/hotel system 1. These servers, terminals, and the like have functions as described below in the casino/hotel.

Various functions for general management of a terminal 4*a* of a front desk 4, cashiers 6*a* and 8*a* of a restaurant 6 and a bar 8, and the like are constructed in a hotel server 2. Various functions to reserve and issue tickets for a variety of shows and events in a hotel are constructed in the service server 10. A function to manage the intranet in the hotel is constructed in an intra-service server 12. A function to comply with a video-on-demand and a game-on-demand at a set-top box 16*a* in a room 16 is constructed in a multimedia server 14.

Various functions to manage an ID card 20 called a house card (card which can identify a guest staying at the hotel), a personal account, and the like are constructed in a house card server 18.

A guest who checked in a casino/hotel, namely a user, is issued with the ID card (house card) 20 to identifying the user by a card issuing machine 4*b* of the front desk 4. Information for identifying the user of the casino/hotel is recorded on the ID card 20. In the present embodiment, information which can identify an individual user (user ID) is recorded on the ID card 20. Note that the ID card 20 may be distributed to each room in the hotel. In this case, ID assigned to each room in the hotel is recorded on the ID card 20.

The user who acquired the ID card 20 can utilize all the facilities in the casino hotel by showing the ID card 20 to be checked. For example, at the cashiers 6*a* and 8*a* of the restaurant 6 and the bar 8 in the hotel, the ID card 20 is read out by card reader 6*b* and 8*b* so that bills are stored on the hotel server 2. Accordingly, all the bills are displayed on the terminal 4*a* of the front desk 4 upon check-out. In other words, the ID card 20 can be linked to various management systems in addition to the undermentioned game management system and has at least a function as a credit card to pay for goods as well as meals and drinks.

Figure 2A:
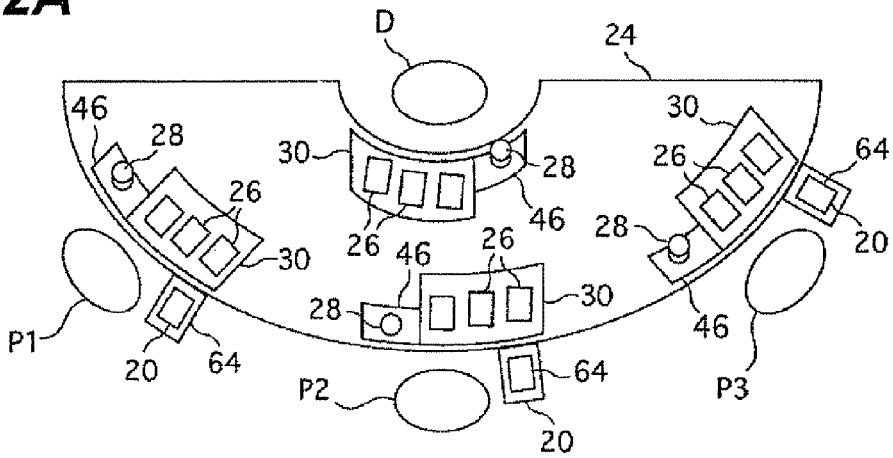
FIG. 2A is a view showing the configuration of a game table.

Various functions are constructed in this game management system of the casino/hotel system 1 to manage different games played on each of game tables 24 in a casino 22. FIG. 2A is a view showing the configuration of the game table 24. In the following description, a card game employing the plurality of cards 26 and chips 28 is played on the game table 24 as shown in FIG. 2A.

This game management system is constructed by resonant tags (card identification information recording means) provided on the plurality of cards 26, a micro wireless ID tag (chip identification information recording means) 44 provided on each of the plurality of chips 28, first identification information detectors (first identification information detecting means) 30, second identification information detectors (second identification information detecting means) 46, a PTS server 66, an accumulation/analysis server 68, and a casino deposit server 72. Herein, the PTS server 66, the accumulation/analysis server 68, and the casino deposit server 72 correspond to the managing means of the present invention.

Figure 2B:
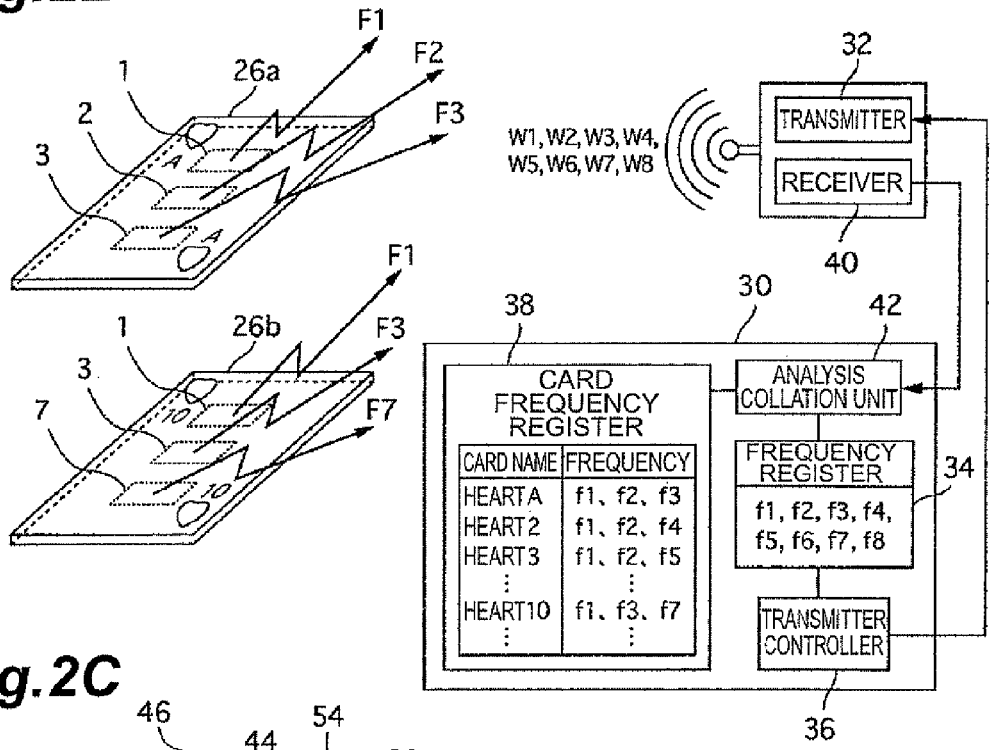
FIG. 2B is a view showing the configuration for detecting card identification information on cards.

FIG. 2B is a view showing the configuration for detecting card identification information of cards. In the present embodiment, the plurality of cards 26 are presumed to be a deck of playing cards, which includes 54 cards. The card identification information to identify individual cards is recorded on the plurality of cards 26. In the present embodiment, a resonant tag is provided on each of the cards 26 to record the card identification information for each of the plurality of cards (playing cards) 26. For example, as shown in FIG. 2B, at least two resonant tags (resonant tags T1, T2, and T3 on the ace of hearts of a playing card 26*a*, and resonant tags T1, T3, and T7 on the ten of hearts of a playing card 26*b*) are disposed on each of the playing cards 26 (refer to 26*a* and 26*b*). In this case, the card identification information on each of the playing cards 26 is configured by a combination of at least two resonant tags. By detecting echo waves (F1, F2 F3, and F1, F3, F7) transmitted from these resonant tags, it is possible to identify specific playing cards (26*a* and 26*b*) from the plurality of playing cards.

As shown in FIGS. 2A and 2B, the first identification information detectors 30 for detecting the card identification information are provided in the vicinities of a dealer D and participants P1, P2, and P3 in the game on the game table 24.

The first identification information detector 30 has a transmitter 32, a frequency register 34, a transmitter controller 36, a card frequency register 38, a receiver 40, and an analysis collation unit 42.

The transmitter 32 transmits electromagnetic waves (W1, W2, W3, W4, W5, W6, W7, and W8) to the plurality of playing cards 26 (26*a*, 26*b*) so that the plurality of resonant tags (e.g., T1, T2, T3 and T1, T3, T7) transmit echo waves (F1, F2, F3 and F1, F3, F7).

The frequency register 34 sets frequencies (f1, f2, f3, f4, f5, f6, f7, and f8) of the electromagnetic waves (W1, W2, W3, W4, W5, W6, W7, and W8) to register. The transmitter controller 36 makes the transmitter 32 to transmit the electromagnetic wave corresponding to each of the frequencies registered in the frequency register 34.

The card frequency register 38 selects combinations of at least two of the frequencies registered in the frequency register 34 (e.g., f1, f2, f3 and f1, f3, f7). Thereafter, the card frequency register 38 associates the selected combinations of at least two frequencies to the plurality of playing cards 26 (26*a* and 26*b*) respectively to register.

The receiver 40 receives the echo waves (F1, F2, F3 and F1, F3, F7) transmitted from the plurality of resonant tags (T1, T2, T3 and T1, T3, T7) when the electromagnetic waves (W1, W2, W3, W4, W5, W6, W7, and W8) are transmitted from the transmitter 32.

The analysis collation unit 42 analyzes each of the frequencies (f1, f2, f3 and f1, f3, f7) of the echo waves (F1, F2, F3 and F1, F3, F7) received by the receiver 40 based on the frequencies (f1, f2, f3, f4, f5, f6, f7, and f8) registered in the frequency register 34. The analysis collation unit 42 collates the combinations of the analyzed frequencies (f1, f2, f3, and f1, f3, f7) with the combinations of the frequencies of the plurality of playing cards 26 (26*a* and 26*b*) registered in the card frequency register 38 to identify the cards.

In order to identify kinds of the 54 playing cards at a minimum number of resonant tags, eight resonant tags, which transmit echo waves with different frequencies, are required. In this case, three resonant tags are combined ($_8C_3$=56) to be disposed on each of the playing cards. Alternatively, when eleven resonant tags are used, two resonant tags are combined ($_{11}C_2$=56) to be disposed on each of the playing cards.

Suppose the case where three resonant tags are combined to be disposed on each of 54 playing cards by using eight resonant tags (only T1 T2, T3, and T7 are shown in the drawing, but T1 to T8 are employed in the actual case). In this case, eight frequencies (f1, f2, f3, f4, f5, f6, f7, and f8) to excite the eight resonant tags are registered with the frequency register 34 of the first identification information detector 30. The card frequency register 38 selects combinations of three of the eight frequencies registered with the frequency register 34. Thereafter, the card frequency register 38 associates the combinations of three selected frequencies with each of the playing cards to register. For example, frequencies (f1, f2, f3) are associated with the ace of hearts, and frequencies (f1, f3, f7) are associated with the ten of hearts. In this case, when the frequencies of the echo waves transmitted from the three resonant tags are (f1, f2, f3), the analysis collation unit 42 identifies the card as the ace of hearts. When the frequencies of the echo waves transmitted from the three resonant tags are (f1, f3, f7), the analysis collation unit 42 identifies the card as the ten of hearts.

Figure 2C:
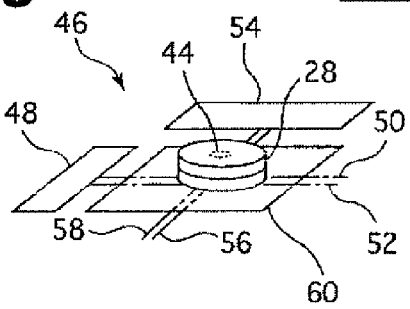
FIG. 2C is a view showing the configuration for detecting chip identification information on a chip.

Chip identification information to identify the chips is recorded on each of the plurality of chips 28. FIG. 2C is a view showing the configuration for detecting chip identification information on a chip. In the present embodiment, as shown in FIG. 2C, a micro wireless ID tag 44 is embedded in each of the plurality of chips 28. The chip identification information to identify the chip is recorded on the micro wireless ID tag 44. A value ($1, $5, $10 or the like), an intrinsic number (a number for identifying the chip), and the like of the chip 28 are registered with the micro wireless ID tag 44. The second identification information detectors 46 which detect the chip identification information recorded on the micro wireless ID tag 44 are provided in the vicinities of the dealer D and the participants P1, P2, and P3 on the game table.

An ID readout device and a chip weighing device 60 constitute the second identification information detector 46. X transmitting and receiving antennas 50 and 52 and Y transmitting and receiving antennas 56 and 58 are perpendicularly disposed to constitute the ID readout device. The X transmitting and receiving antennas 50 and 52 extend from an X scan driver 48 parallel to each other. The Y transmitting and receiving antennas 56 and 58 extend from a Y scan driver 54 parallel to each other.

According to the ID readout device, electric waves are generated in the vicinities of the cross points of the antennas when scanning electric waves are transmitted from the X and Y transmitting antennas 50 and 56 while the chip 28 is bet on the game table 24 (the second identification information detector 46). These electric waves are received by the X and Y receiving antennas 52 and 58. However, when the chip 28 is bet in the vicinities of the cross points, impedance varies due to the dielectric chip 28. As a result, reception of the electric waves changes at the X and Y receiving antenna 52 and 58. By detecting the change in the reception of the electric waves, the presence of the chip 28 is determined. Simultaneously, the X and Y receiving antennas 52 and 58 receive signals from the micro wireless ID tag 44, the kind ($1, $5, $10 or the like), the intrinsic number (number for identifying the chip) and the like of the chip 28 are read out.

The chip weighing device 60 is disposed to cover the betting area. An electric weighing instrument such as a semiconductor pressure sensor, for example, can be used as the chip weighing device 60. Weight per chip is recorded on the chip weighing device 60. Consequently, it is possible to calculate the number of bet chips 28 by dividing the total weight by the weight per chip.

In this game management system, users who wish to play a card game at the casino 22 (refer to FIG. 1) obtain the desired number of chips 28 at the chip issuing/adjusting machine 62 when the users enter the casino with the aforementioned ID card 20. The users who obtained the chips 28 set the ID cards 20 at the readout unit 64 of the game table 24. The readout unit 64 reads out the contents of the ID cards 20, in other words, the user IDs recorded on the ID cards 20 to identify the users. Thus, the readout unit 64 recognizes the users as the participants in the game.

Data recognized by the readout section 64, in other words, the user IDs are sent to the PTS (Player Tracking System) server 66 and registered as participants (P1, P2, and P3) in the present game. Note that the readout process can be arbitrarily set (magnetic or optical readout process) in accordance with the recording method (magnetic or optical recording) of the ID cards 20.

The PTS server 66, the accumulation/analysis server 68, and the casino deposit server 72 are server devices physically comprising CPU (Central Processing Unit), a memory device such as a memory, data storage device such as a hard disk, and a communication device or the like for connecting to the hotel/casino system 1 via network, respectively.

The PTS server 66 manages tables for registering data including all the histories of the cards and all the histories of the chips at the game table. The accumulation/analysis server 68 accumulates and analyzes data including all the histories of the cards and all the histories of the chips, which are registered with the PTS server 66.

FIG. 3A is a view showing an example of a table managed by the PTS server regarding all the histories of the cards. As shown in FIG. 3A, when the dealer D deals the cards (playing cards) 26 at the beginning of the game, the first identification information detector 30 detects the kinds and the number of playing cards 26. Data (the kinds and the number of the playing cards 26) detected by the first identification information detector 30 is transmitted to the PTS server 66. During the game, the first identification information detector 30 sequentially detects the movement history of the playing cards 26 exchanged between the dealer D and the participants P1, P2, and P3. This detected data is transmitted to the PTS server 66. Specifically, the movement paths and the movement directions of the playing cards 26 are easily and accurately detected and registered with the PTS server 66 only via the first identification information detector 30 of the game table 24. At the end of the game, the first identification information detector 30 detects the kinds and the number of the remaining playing cards 26. This detected data is transmitted to the PTS server 66. As a result, all the tracks of the playing cards 26 in the card game are sequentially registered with the table managed by the PTS server 66 and managed by the accumulation/analysis server 68 collectively.

FIG. 3B is a view showing an example of a table managed by the PTS server regarding all the histories of the chips. As shown in FIG. 3B, the chips 28 bet during the card game are constantly detected by the second identification information detector 46 (ID readout device). The values of the chips 28 ($1, $5, $10 or the like), in other words, the kinds, the intrinsic numbers (number for identifying the chips), and the like are read out. At the same time, the chip weighing device 60 calculates the number of bet chips 28 accurately. All of these data (the kinds, the intrinsic numbers, and the number of the bet chips) are sequentially transmitted to the PTS server 66 and registered with the table managed by the PTS server 66 from the beginning until the end of the game. The accumulation/analysis server 68 refers the data including the kinds, the number, and the like of remaining chips 28 at the end of the game, which are registered with the PTS server 66. Thus, it is possible to calculate the total amount of remaining money accurately in a short period of time. Therefore, all the tracks of the chips are sequentially registered with the PTS server 66 and managed by the accumulation/analysis server 68 collectively.

FIGS. 4, 5A to 5C and 6 are views showing tables of another example, which are managed by the PTS server 66. These drawings show tables managed by the PTS server 66 when poker is played as the game.

FIG. 4 is a view showing an example of a table managed by the PTS server regarding the results of games. A game table ID, a game start time, a game end time, an investment, a return, and a fraud detection flag are registered with the table shown in FIG. 4 in association with the user ID read out from the ID card 20. Once the participant places the ID card 20 on the readout unit 64 when participating the game at the game table 24, the user ID read out from the ID card 20 by the readout unit 64 is registered with the table as shown in FIG. 4. At this time, the user ID is registered in association with a history number, which is automatically numbered. In the example shown in FIG. 4, the name of the user is registered as the user ID, such as "Taro Aruze." Moreover, the game start time and the game table ID for identifying the seat at the game table are registered in association with the user ID.

FIGS. 5A, 5B, and 5C are views showing the tables of an example, with which the histories of the playing cards 26 used in the game are registered. FIG. 5A shows a table regarding the playing cards 26 dealt for the participants in the game at the beginning of the game. FIG. 5B shows a table regarding the movement histories of the playing cards 26 during the game. FIG. 5C shows a table regarding the remaining playing cards 26 at the end of the game.

A game number, which is automatically numbered, is registered with each of the tables shown in FIGS. 5A, 5B, and 5C for each poker game. As shown in FIG. 5A, the game table ID for identifying the seat at the game table, the number of playing cards ("NUMBER OF CARDS" in the drawing) at the beginning of the game, the kinds of the playing cards 26 ("CARDS 1 to 5" in the drawing), and the dealt time thereof ("TIME" in the drawing) are registered with the tables at the beginning of the game in association with the game number.

As shown in FIG. 5B, the movement tracks of the playing cards 26 ("MOVEMENT HISTORIES OF CARDS" in the drawing) as well as the game table ID and the movement time ("TIME" in the drawing) are registered with the tables in association with the game number during the game. Referring to FIG. 5B, it is recorded that the two of clubs was exchanged for the three of clubs as a first data of the table. In addition, it is recorded that the five of clubs was exchanged for a counterfeit card which was unrecognizable by the first identification information detectors 30 as a second data of the table.

As shown in FIG. 5C, the number of playing cards 26 at the end of the game ("NUMBER OF CARDS" in the drawing), the kinds of the remaining playing cards 26 at the end of the game ("CARDS 1 TO 5" in the drawing) as well as the game table ID and the end time of the game ("TIME" in the drawing) are stored in association with the aforementioned game number at the end of the game. Referring to FIG. 5C, it is recorded that five cards were remained at the end of the game as a first data of the table. In addition, it is recorded that four cards and a counterfeit card were remained for at the end of the game as a second data of the table.

FIG. 6 is a view showing an example of a table managed by the PTS server regarding the chips 28. In the example shown in FIG. 6, the aforementioned game number is registered with the table for each poker game. The number of bet chips 28 as well as a bet time are registered with the table in association with the game number for each kind of the bet chip ("$1, $5, $10" in the drawing). In addition, upon the chip return, the return time and the number of returning chips are registered with the table for each kind of chip.

Referring back to FIG. 4, when the participant in the game removes the ID card 20 from the readout unit 64, the time thereof is recognized as the game end time and registered with the table shown in FIG. 4. The accumulation/analysis server 68 refers the foregoing table managed by the PTS server 66 as shown in FIG. 6. Accordingly, the accumulation/analysis server 68 calculates the investment and the return of the participant in the game to be registered with the table in association with the user ID of the participant (refer to FIG. 4). Herein, the accumulation/analysis server 68 can acquire the kinds and the number of bet chips and the kinds and the number of returning chips for each user from the table shown in FIG. 6 by referring the game table ID, the game start time, and the game end time shown in FIG. 4, which are associated with the user ID. Thus, it is possible to calculate the investment and the return for each user and register the same in association with the user ID.

The ID card 20 is provided with a deposit checking unit 70 (refer to FIG. 1) for checking the amount of deposit of the user. In the foregoing embodiment, the chips 28 are directly bet. However, various games, in other words, the card games can be played in accordance with the checking results of the deposit checking unit 70 instead of the chips 28. In this case, the participants P1, P2, and P3 can bet arbitrary amount of money by using bet inputting means 90 (e.g., a numeric keypad) at hand. Similar to the aforementioned chips 28, all the bets are sequentially registered with the PTS server 66 and collectively managed by the accumulation/analysis server 68. The casino deposit server 72 manages the deposits in the casino collectively (refer to FIG. 1). Thus, it is possible to update the deposit balance in accordance with the points of the game results and pay an additional deposit without cash.

As described above, according to the game management system 1 in the present embodiment, it is possible to manage all the histories of the cards 26 and the chips 28 from the beginning until the end of the game. Accordingly, by referring the data registered with the PTS server 66, the accumulation/analysis server 68 can detect a fraud game and operation. Therefore, it is possible to prevent the fraud game and operation.

Specifically, each of the cards 26 and the chips 28 are constantly monitored by the first and second identification information detectors 30 and 46 respectively and registered with the tables managed by the PTS server. Thus, it is possible to find the counterfeits instantly when a counterfeit card or a counterfeit chip enters during the game. For example, when the number of cards is small, the accumulation/analysis server 68 refers the tables in FIGS. 5A to 5C to detect the deficiency in the number of cards. Accordingly, the fraud can be detected. More specifically, when poker is played as the game and four cards are registered with the table shown in FIG. 5C as the number of cards, the accumulation/analysis server 68 detects the number as the fraud of the game. When the cards are moved in such a direction that the movement is forbidden in the game, the accumulation/analysis server 68 can detect the fraud by referring the tables in FIGS. 5A to 5C. Thus, the accumulation/analysis server 68 can accurately follow the fraud operation time and the flow of the cards 26 at that time based on the histories of the cards 26 detected by the first identification information detector 30, even when the cards 26 are illegally manipulated in the conspiracy of the dealer D and the participants P1, P2, and P3.

In addition, the accumulation/analysis server 68 can detect a counterfeit chip by checking whether there is a contradiction in a relationship between the bet chips and the return. This checking is performed from the odds of the hand based on the kinds of cards at the end of the game, the kinds and the number of bet chips, and the kinds and the number of a return. For example, by preparing a table, with which a relationship between the odds and the kinds of cards is registered, in the PTS server 66, it is possible to acquire the odds of the hand from the kinds of the playing cards 26 at the end of the game registered with the table shown in FIG. 5C. When there is a contradiction between the acquired odds of the hand and the relationship between the bet chips and the return shown in FIG. 6, the contradiction can be detected as the fraud.

When detecting the fraud, the accumulation/analysis server 68 registers the fraud detection flag ("1" in the drawing indicates that the fraud is detected) with the table shown in FIG. 4 in association with the user ID. The game management system of the present embodiment can thus prevent the fraud operation since the game management system can detect the fraud operation.

According to the present embodiment, the user can utilize all the facilities with the ID card 20 (house card) given when checking in a hotel. Thus, the hotel can provide obliging services for its guests. Especially, since a game charge at a casino has been billed separately in conventional casino hotels, casino users have been irritated by the fact that the users have to manage their funds on their own. However, the ID card 20 enables the user to pay for all the bills upon check-out. As a result, burdens are reduced for the casino users.

Moreover, by utilizing the deposit function of the ID card 20, it is possible to set a limit on playing games. This eliminates extreme losses for the users, and thus the users can feel relaxed to play the games.

The principles of the present invention have been illustrated and described in the preferred embodiments, but it is apparent to a person skilled in the art that the present invention can be modified in arrangement and detail without departing from such principles. For example, poker has been an example of the game to describe the aforementioned embodiment. However, the game management system of the present invention can also manage card games such as Let it Bet or the like. In addition, the ID card 20 can be used for gaming machines provided in the casino 22, such as roulettes 74 and slots 76, although the descriptions thereof are omitted. The game histories thereof can be registered with the PTS server 66 in data formats as shown in FIG. 3 and collectively managed. We, therefore, claim rights to all variations and modifications coming with the spirit and the scope of claims.

What is claimed is:

1. A game management system for identifying a game participant, from a plurality of game participants, who commits a fraud in playing a game, the game management system comprising:

a game table for playing a game that employs a plurality of game cards that each include a plurality of resonant tags configured to transmit a respective combination of different frequencies, and a plurality of game chips, the game table including, a reader reading information identifying the game participants in the game;

a first detector detecting information concerning respective game cards distributed on the game table, the first detector including a transmitter transmitting a first electromagnetic signal to the game cards distributed on the game table, a receiver receiving respective combinations of different frequencies transmitted from the resonant tags of each of the plurality of game cards in response to the first electromagnetic signal, and an analysis collation unit detecting respective kinds of the game cards distributed on the game table by analyzing the combinations of the different frequencies received; and a second detector detecting information concerning respective game chips, the information concerning respective game chips including a total bet amount on the game table during the game and a return amount to be paid at end of the game;

a management server communicating with the game table, the management server including a processor and a storage device configured for storing a plurality of data items transmitted from the game table and comparing the data items for detecting a fraud by a specific game participant in playing the game on the game table, based on an analytical of the plurality of data items stored, the management server storage device including:

a first data table including historical data of the respective game cards used by the game participants in the game, from beginning to the ending of the game, based on the information received from the game table and that identifies the game participants in the game and the information received from the game table that concerns respective game cards, the historical data of respective game cards serving as a record of movement history of the respective game cards of the respective game participants, from the beginning to the ending of the game, and a second data table including historical data of respective game chips used by the game participants in the game, from the beginning to the ending of the game, based on the information received from the game table that identifies game participants in the game and the information received from the game table that concerns respective game chips, wherein the first data table is composed of a first set table including information concerning respective game cards at a beginning of the game, a second set table including information concerning respective game cards between the beginning of the game to the ending of the game, and a third set table including information concerning respective game cards at the ending of the game, the game table continuously transmits to the management server, from the beginning to the ending of the game, the information identifying the game participants in the game that is read by the reader, the information concerning respective game cards that is detected by the first detector, and the information concerning respective game chips that is detected by the second detector;

the management server tracks the movement history of the game cards by comparing the historical data concerning respective game cards obtained from the first data table, from the beginning to the ending of the game, for detecting a fraud by the specific game participant, the management server detects the fraud by the specific game participant in playing the game on the game table by comparing the historical data concerning respective game cards obtained from the respective set tables of the first data table and the historical data concerning respective game chips obtained by referring to the second data table, with the game cards and the game chips used by the specific game participant in the game, from the beginning to the ending of the game, and when a fraud is detected, the management server sets a fraud detection flag identifying the specific game participant who committed the fraud based on the user information obtained from the respective set tables of the first data table or the second data table.

2. The game management system according to claim 1, wherein:

the first detector verifies whether each game card is valid;

the game table transmits to the management server only information concerning valid game cards from among the game cards verified by the first detector and distributed on the game table;

the management server records in the first data table, as the historical data, only the information concerning the valid game cards that is received from the game table; and the management server detects the fraud committed by the specific game participant playing the game by determining that the total number of game cards used at the beginning of the game is not equal to the total number of game cards used during the game by referring to the first data table, and determining, by referring to the second data table, the return amount to be paid at the ending of the game.

3. The game management system according to claim 1, wherein:

the management server acquires odds of obtaining a respective hand of the game cards, as a combination of the game cards, by referring to the first data table, based on information concerning respective kinds of the game cards at the ending of the game; and the management server detects the fraud committed by the specific game participant playing the game by determining that there is a contradiction between the total bet amount and the return amount, based on the odds of the hand of the game cards obtained by referring to the first data table, and the information concerning total number and respective kinds of the game chips bet during the game and the total number and respective kinds of the game chips paid at the ending of the game, by referring to the second data table.

4. The game management system according to claim 1, wherein:

each of the plurality of game chips incorporates a wireless ID tag storing a value and identification information identifying each of the game chips;

the second detector includes an ID readout device reading the value and the identification information identifying each of the game chips, based on signals transmitted from the wireless ID tags in response to a second electromagnetic signal that is transmitted to the game chips bet during the game;

a chip weighing device records weight per game chip; and the second detector detects the total number of the game chips used, from the beginning to the ending of the game, based on the values and the identification information of the game chips read by the ID readout device, and the weight of the game chips used, from the beginning to the ending of the game, from the total weight of the chips determined by the chip weighing device and dividing total chip weight by the weight per game chip.

5. The game management system according to claim 1, wherein:

the reader reads the information identifying the game participants using an ID card usable at all facilities of a hotel, the ID card storing information identifying a guest of the hotel;

the ID card includes a deposit checking unit checking amount of a deposit made by the guest; and the game table controls the game in accordance with a check by the deposit checking unit of the ID card so that a game participant in possession of an ID card can play the game without using a game chip.

6. The game management system according to claim 1, wherein the game participants include a dealer conducting the game.

7. A game management system comprising:

a game table for playing a game that employs a plurality of game cards that each include a plurality of resonant tags configured to transmit a respective combination of different frequencies in response to an electromagnetic signal, and a plurality of game chips, the game table including, a reader reading user information identifying the game participants in the game;

a first detector detecting information concerning respective game cards distributed on the game table, the first detector including a transmitter transmitting a first electromagnetic signal to the game cards distributed on the game table, a receiver receiving respective combinations of different frequencies transmitted from the resonant tags of each of the plurality of game cards in response to the first electromagnetic signal, and an analysis collation unit detecting respective kinds of the game cards distributed on the game table by analyzing the combinations of the different frequencies received; and a second detector detecting information concerning respective game chips on the game table;

a management server including a processor and a storage device, the management server storage device comprising:

a first data table including historical data of the respective game cards based on the user information and the information concerning respective game cards received from the game table, and a second data table including historical data of respective game chips based on the user information and the information concerning respective game chips received from the game table, wherein the first data table is composed of a first set table including information concerning respective game cards at beginning of the game, a second set table including information concerning respective game cards during a period between the beginning of the game and the ending of the game, and a third set table including information concerning respective game cards at ending of the game, the management server detects the fraud and obtains the user information corresponding to the fraud by comparing the historical data of the respective set tables of the first data table or the second data table, and then sets a fraud detection flag identifying the specific game participant who committed the fraud based on the user information obtained from the respective set tables of the first data table or the second data table.

8. The game management system according to claim 7, wherein:

each of the plurality of game chips incorporates a wireless ID tag storing a value and identification information identifying each of the game chips;

the second detector includes an ID readout device reading the value and the identification information identifying each of the game chips, based on signals transmitted from the wireless ID tags in response to a second electromagnetic signal that is transmitted to the game chips bet during the game;

a chip weighing device records weight per game chip; and the second detector detects the total number of the game chips used, from the beginning to the ending of the game, based on the values and the identification information of the game chips read by the ID readout device, and the weight of the game chips used, from the beginning to the ending of the game, from the total weight of the chips determined by the chip weighing device and dividing total chip weight by the weight per game chip.

* * * * *